United States Patent [19]

Crema

[11] 4,194,978

[45] Mar. 25, 1980

[54] METHOD AND DEVICE FOR REMOVING SOLID AND/OR LIQUID MEANS CONTAINING HARMFUL SUBSTANCES

[76] Inventor: Erhard Crema, Leuchte 96, Frankfurt am Main, Fed. Rep. of Germany, 6000

[21] Appl. No.: 972,462

[22] Filed: Dec. 22, 1978

[30] Foreign Application Priority Data

Dec. 24, 1977 [DE] Fed. Rep. of Germany ..... 2758038

[51] Int. Cl.[2] ..... B04C 1/00

[52] U.S. Cl. ..... 210/242 S; 210/512 R; 210/DIG. 25; 210/DIG. 26

[58] Field of Search ..... 210/74, 84, 167, 169, 210/512, 194, 195 R, 195 S, 196, 197, 120, 153, 171, 172, 73 R, 73 W, 83, 242 S, 242 R, 241, 512 R, 416 R, DIG. 25, DIG. 26; 137/563, 604; 134/10, 109–111

[56] References Cited

U.S. PATENT DOCUMENTS

| | | | |
|---|---|---|---|
| 2,381,760 | 8/1945 | Latham | 210/74 |
| 3,528,551 | 9/1970 | Herubel | 210/196 |

*Primary Examiner*—Frank Sever

*Attorney, Agent, or Firm*—Dennison, Dennison, Meserole

[57] ABSTRACT

A method and apparatus for removing solid and/or liquid matter containing harmful substances from the ground or from surfaces of liquids. A vacuum up to 0.1 bar is generated by a water jet pump, whereby the matter can be sucked up even over differences in height of almost 10 meters. The water jet pump is arranged in a closed water circulation system which uses a centrifugal pump for its drive, preferably a fire-extinguishing pump. In order to prevent the harmful substances from getting into the water circulation, a collecting vessel is arranged in the suction line for the matter containing harmful substances.

12 Claims, 7 Drawing Figures

METHOD AND DEVICE FOR REMOVING SOLID AND/OR LIQUID MEANS CONTAINING HARMFUL SUBSTANCES

This invention relates to a method for removing solid and/or liquid waste containing harmful substances by means of suction generated by a vacuum, as well as to apparatus for carrying-out the method.

On a continuously increasing scale devices are required to remove waste products or harmful substances resulting from manufacturing processes or suddenly occurring unforeseeable events, as e.g. acids, caustic solutions, oil or other harmful liquids, as well as solids of various grades. In this regard the known devices operate by air suction which draws the harmful substances into a transport means. In these devices the vacuum is generated either by means of an electric motor or by compressed air. In those devices where the vacuum is generated by means of an electric motor, there is the necessity for the availability of a source of current, so that it is rather difficult to use them in impassable districts. The reason for this is that the moving of electric generators to the scenes of accident is often rather difficult and takes too much time in order to remove the harmful substances quickly enough without risk of contamination or epidemics. Besides, such devices are not suitable for the removal of matter with a risk of explosion, since there is the danger of sparks developing in the electric motor or, respectively, in the supply lines. Those devices driven by compressed air have the disadvantage that for their operation the availability of connections for compressed air is required, and thus there is little possibility of using them outside of industrial plants provided with compressed air supply.

However, an essential demand that must be made on devices for the removal of harmful substances is their movability. It is therefore the object of the present invention to provide a method, as well as apparatus for carrying out this method, by which the removal of harmful substances can take place in a simple manner without necessitating any expensive or additional driving gear. In addition thereto, the removal of matter containing harmful substances may be accomplished with such reliability that not only liquids can be drawn out from a depth of almost 10 meters but also e.g. the water resulting from fire-extinguishing operations can be completely drawn off so as to preclude any greater damage caused by water. Thus by means of the invention a "dry sucking" is possible. Also the invention ensures that the source for generating the suction air cannot contact the harmful substances so as to ensure highly efficient performance.

The prior art problems are solved by my new method wherein vacuum is generated by a water jet pump arranged in a closed cycle and driven by water flowing therein, and wherein the sucked up matter is kept away from the cycle.

By the system according to the invention it is ensured that for the operation of the water jet pump no water will be wasted by using the water flowing through the pump but once. Therefore the method according to the invention is environmentally sound since the water is reused. However, in order that the water circulation is not contaminated by harmful substances and that water need not be replaced after each operation, the matter containing the sucked up harmful substances are kept away from the water circulation. Preferably the solid and/or liquid matter is drawn up via a suction tube provided with a collecting vessel to separate the matter and thus the harmful substances as well. However, in order to prevent harmful substances from entering the water circulation via the suction sleeve of the water jet pump when the collecting vessel is filled up, no more suction air will flow through the collecting vessel once a fixed filling height has been reached and simultaneously a connection is made between ambient air and the water jet pump. In this case the water jet pump will suck only up atmospheric air. In order to ensure that no additional driving elements are required to drive the water jet pump, i.e. to feed the water to the circulation, according to the invention it is preferred to use a conventional fire-extinguishing pump as a feeding means for the water. This means that with the aid of equipment always available in fire engines, the method according to the invention can be carried out. Consequently no additional sources of power are required except for the fire brigade trucks available in every community and in larger plants.

The apparatus according to the invention designed to carry out the method is characterized by the fact that the partial vacuum source is a water jet pump arranged in an endless circulation that can be operated by water delivered in the circulation, whereby the matter can be drawn up via a suction line connected to the suction face of the water jet pump, which line leads through a collecting vessel to segregate the matter from the water circulation. To deliver the water in the circulation, it is preferable to use a centrifugal pump, especially of the fire-extinguishing type. This will ensure that at any time and at almost all locations, independently of available electric or pneumatic connections, and at optimum reliability of service, the removal of liquid or solid matter containing harmful substances can take place. In order to have sufficient water available for the circulation, the tank of fire engines having at least one ventilation opening can be used. Thus the circulation is composed of the tank as a receiver of the hydraulic seal, as well as a connection between the water feed opening and the water discharge opening of the tank, while in the connecting line there are arranged in tandem the centrifugal pump and the water jet pump. Thus the method according to the invention can be effected with simple auxiliary apparatus. As the known fire-extinguishing pumps have working pressures of 8 bars or even 12 bars, there is also the important advantage that liquids can be sucked up from depths of almost 10 meters. That means that a fire engine can be placed at the slope of a hill in order to remove harmful substances at its base. This can be of importance especially if an oil tank of a freight car has leaked out and a fire engine cannot get directly to the place of the accident but rather must do the cleaning work from a viaduct situated at a distance therefrom. With the aid of the apparatus according to the invention where available equipment of fire engines is preferably used, the removal of matter containing harmful substances does not present any difficulties even at very high differences of elevation.

Should fire engines be used that do not have an integral tank, then a conventional standard barrel can serve as a vessel for the hydraulic seal. For a driving means to deliver the water in the circulation, however, the fire-extinguishing pump of the vehicle can be used.

In order to preclude the sucked up matter and thus the harmful substances from entering the water circulation, the matter is preferably led into a collecting vessel provided with a cover in such a manner as to cause a tangential movement of the matter relative to the walls thereof. The delivery air arriving at the suction sleeve of the water jet pump is discharged through an opening provided with a valve in the cover of the collecting vessel. Thereby the valve can be actuated by a float in the collecting vessel in such a manner that the valve will establish a connection to the ambient air prior to the sucked up matter reaching the discharge opening for the delivery air. By this connection to the ambient air the sucking-up of the solid and/or liquid matter containing the harmful substances is stopped and the water jet pump will take in only ambient air. Thus the cover of the collecting vessel is formed as a cyclone cap.

With the aid of the device according to the invention liquids can actually be sucked up from depths exceeding 9 meters the water jet pump is configured in such a manner that a partial vacuum of preferably at least 0.1 bar is generated provided that the centrifugal pump arranged in the water circulation has a working pressure of preferably 8 bars up to preferably approximately 12 bars.

If the device is used with a fire engine that does not have its own tank or a tank not ready for operation, then the hydraulic seal to be used is preferably a standard barrel with a capacity of 200 liters having a cover curved to the outside, through which are led the pipe unions for the water feed to or, respectively, the water return from the water jet pump. At the same time the surface of the cover has openings to let the air escape. In order to prevent the water coming from the water jet pump from spurting through the venting openings in the cover of the barrel, the compressed water coming from the water jet pump within the range of the cover, approximately horizontally outside of the openings, is led into a water tank provided with openings on its bottom, through which the compressed water and the delivery air will reach the lower region of the vessel.

In order to obtain a high suction output of the water jet pump, only a small amount of air must be admitted to same. For this purpose the pipe union for the water feed has a suction pipe extending into the ground area. That is to say, in this area the returned water has settled and has only a low percentage of air left.

In order to ensure that no harmful substances will get into the closed circulation via the suction line, the valve in the cover opening of the collecting vessel has an upper part of the housing arranged toward the suction face of the water jet pump and a lower part of the housing provided with openings, in which a hollow piece movable by the float is slidingly arranged. As soon as the collecting vessel is sufficiently filled up, the float will be lifted and thus the hollow piece will move. By lifting the hollow piece within the lower part of the housing, a connection is established between the suction face of the water jet pump and the openings in the lower part of the housing. Thereby a further sucking up of the liquid and/or solid matter containing the harmful substances is stopped. In order to guarantee that during the suction process the hollow piece within the valve body is not moved, the hollow piece is of cylindrical configuration provided with collars on both ends extending to the outside, whereby atmospheric pressure can be admitted to the lower collar via the openings in the lower part of housing, and which collar has a larger surface than the upper collar to which the partial vacuum is admitted.

In order that matter can be sucked up e.g. from contaminated water surfaces, liquid matter can be sucked up via a skimmer of rectangular outline, of which two opposite sides are configured as raising bodies, which again are connected with each other in such a manner that the matter will enter the intermediate space and flood a first plate provided with holes between the lifting bodies of the skimmer. In order to permit a simple and complete removal of the harmful substances, the suction pipe which preferably is adjustably arranged, is connected with the skimmer in such a manner that the harmful substances can be sucked up from the surface of the liquid through the holes of the first plate, in that parallel to the first plate a second closed plate is arranged as the bottom of the skimmer.

Further details, advantages and characteristics of the invention will be apparent upon consideration of the following description of the accompanying drawings wherein.

Figure 1:
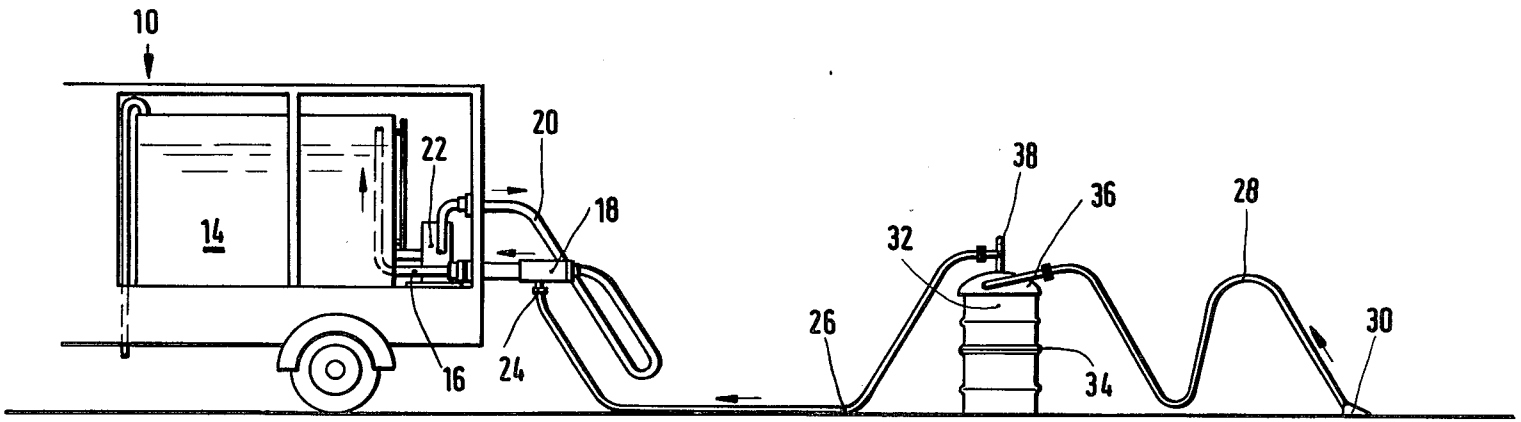
FIG. 1 is a side elevation of the apparatus for removing matter containing harmful substances, where a fire brigade truck with an integral tank is used.
Figure 2:
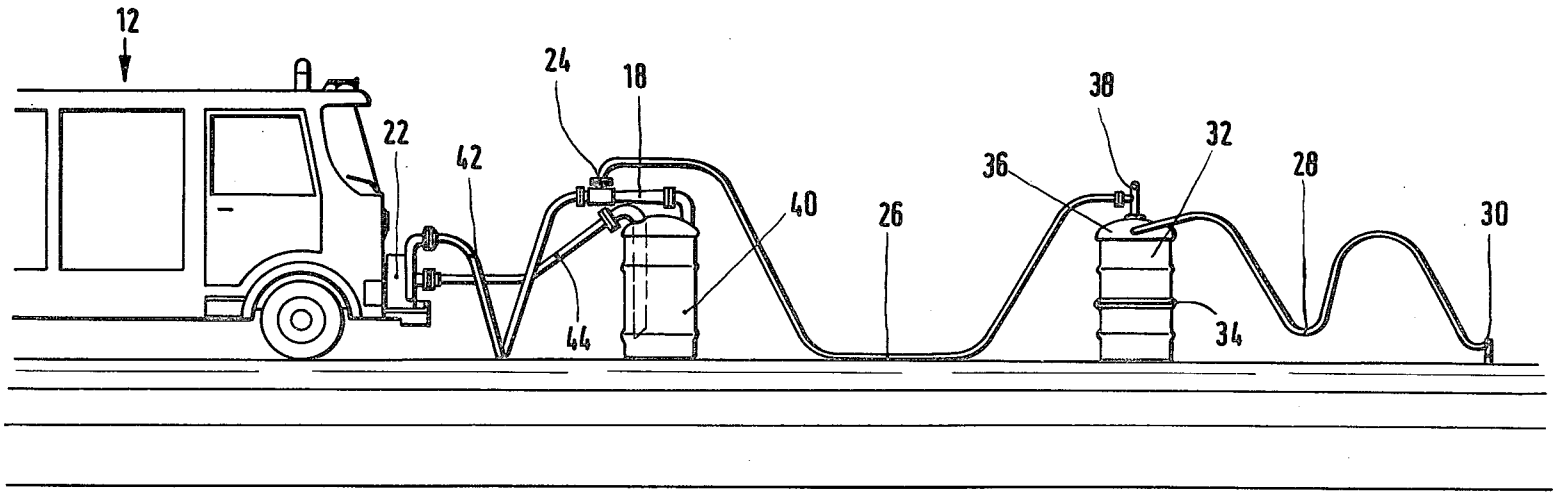
FIG. 2 is a side elevation similar to FIG. 1 where a fire brigade truck is used which does not have an integral tank.

Referring to FIGS. 1 and 2, each is a schematic view of the apparatus where a fire brigade truck 10 and 12 respectively is used. The fire engine 10 in FIG. 1 has an integral water tank 14. To the tank filler 16 for the water feed there is preferably connected the discharge channel of a water jet pump 18 via a connecting piece not specified further. The power water feed of the water jet pump, through a delivery hose 20, is connected to a fire-extinguishing pump 22 configured as a centrifugal pump, of which the inlet opening is connected to the water tank 14. By actuating the fire-extinguishing pump 22, water from the tank 14, via the pump 22, the delivery hose 20, is forced through the water jet pump 18, in order to again flow into the tank via the tank filler 16. At a working pressure of the fire-extinguishing pump 22 of preferably 8 to 12 bars, a partial vacuum of approx. 0.1 bar is generated at the suction sleeve of the water jet pump 18. This pressure drop is utilized to suck up the matter to be removed via a vacuum hose 26 or, respectively, suction hose 28, through a nozzle 30. In order to prevent the sucked-up matter mixed with harmful substances from getting into the water circulation composed of the tank 14, the fire-extinguishing pump 22, the delivery hose 20, the water jet pump 18 and the tank 14 through the tank filler 16, a collecting vessel 32 is mounted between the vacuum hose 26 and the suction hose 28. Preferably, the collecting vessel 32 is designed like a standard barrel provided with a reinforcing ring 34 (FIG. 3), to prevent the collecting vessel 32 from imploding when the matter is sucked up. Preferably the reinforcing ring 34 is a T-iron adapted to the barrel 32 of which one web is arranged outwardly. Thereby the ring 34 is divided in two equal halves and is held together by a hinge and a coupling nut. In order to prevent it from slipping on the barrel, the ring is provided with an inner rubber strip. By the reinforcing ring 34 one can prevent deformation of the barrel 32 from taking place.

The collecting vessel 32 is covered by a cap 36 configured like a cyclone cover. Further the cover accommodates a ventilation valve 38. The cyclone cover 36 as well as the ventilation valve 38 will be described in more detail in conjunction with FIGS. 3 and 4. In order to prevent the suction hose 28 from being electrostaticly charged, it is grounded. Thus it is ensured that by means of the apparatus according to the invention even explosive harmful substances or matter, respectively, can be sucked up.

In FIG. 2 there is shown an apparatus according to the invention that does not use the tank of the fire engine 12 as a hydraulic seal but rather employs a barrel 40 positioned outside of the fire engine 12. Otherwise the embodiment according to FIG. 2 uses the same means as described in FIG. 1 so that the same reference numbers are used. The closed circulation, in which the water jet pump 18 as well as the fire-extinguishing pump 22 are arranged, consists of a delivery hose connection 42 between the centrifugal pump 22 and the power water feed of the water jet pump 18, the barrel 40 as well as a water return line 44 between the barrel 40 and the centrifugal pump 22. In the embodiment according to FIG. 2, the harmful substances are kept away from the above described closed water circulation by means of the collecting vessel 32 described in conjunction with FIG. 1. A more detailed description of the construction of the barrel 40 for the hydraulic seal of the closed water circulation will follow in connection with the FIGS. 5 and 6.

Figure 3:
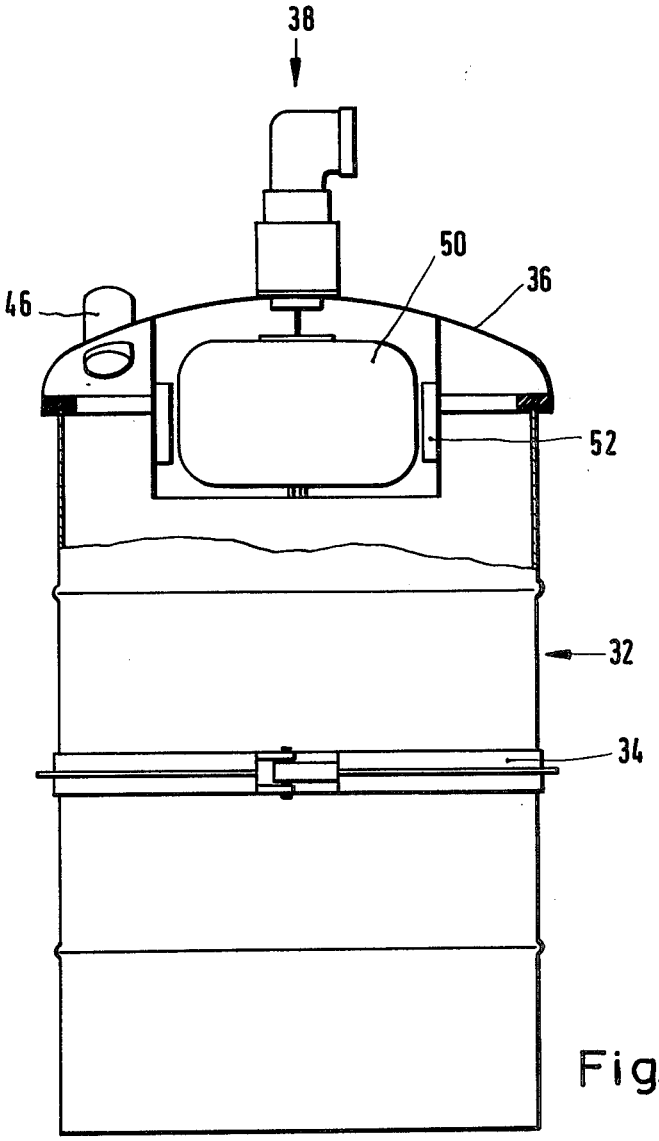
FIG. 3 is a front elevation, partly in section, of a collecting vessel to receive the matter containing the harmful substances.

FIG. 3 is an enlarged view of the collecting vessel 32 of FIGS. 1 and 2. Preferably this vessel is a standard barrel open at one end, having as a reinforcement the supporting ring 34. The cover 36 of the collecting vessel 32 is configured as a cyclone cover. The matter containing the harmful substances sucked up through the suction line 28, is tangentially led into the cover through a suction sleeve 46. The delivery air sucked into the water jet pump 18 is taken from the collecting vessel 32 through a ventilation valve 38 arranged at the cover 36. The mode of operation of the ventilation valve 38 will be described in more detail in connection with FIG. 4. Further, a float 50 is shown in FIG. 3 that actuates the ventilation valve 38. Between the float 50 and the tangential feeding means for the matter containing the harmful substances ther is a wall 52 for preventing an immediate impact of liquids on the float. In order to obtain an air-tight seal between the cover 36 and the lower part of the collecting vessel, packing rings are arranged in the marginal area of the cover 36.

Figure 4:
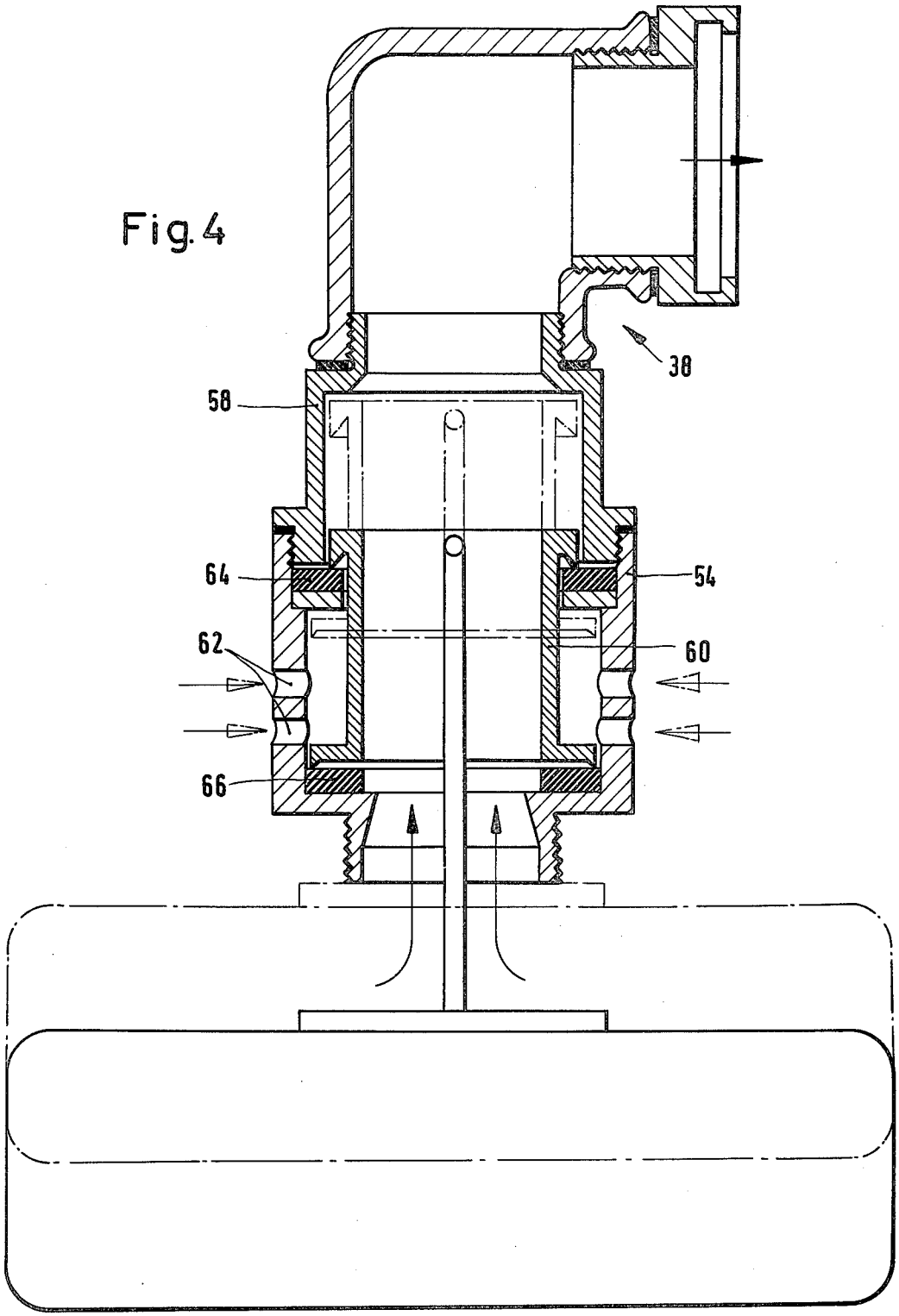
FIG. 4 is a sectional view of a ventilating valve for the collecting vessel according to FIG. 3.

FIG. 4 is an enlarged view of the ventilation valve for the collecting vessel 32 through which the delivery air for sucking in the matter passes to the water jet pump 18. The ventilation valve 38 consists of a valve body, having a lower housing 54 and an upper housing 58. In the valve body there is a trunk piston 60 lifted by the float 50 when it reaches the maximum filling height in the vessel 32, whereby openings 62 in the lower housing cause a connection of the surrounding air to the inside of the valve, so that any further sucking-up of matter to be removed from a surface is stopped due to the sudden pressure compensation. Thereby it is ensured that no harmful substances can get into the above described closed circulation. If at the start of a cleaning process the cover 36 is put on the vessel 32, an immediate sealing will result provided that the water jet pump 18 is in operation. Thereby the trunk piston 60 seals the opening 62. By the construction of the trunk piston 60 according to the invention, its remaining in this position is guaranteed. That is to say, the trunk piston 60 is of cylindrical configuration with collars extending outwardly at the ends. The free surface of the lower collar is greater than the surface of the upper collar. Atmospheric pressure passing through the opening 62 is now admitted to the lower collar surface, while the depression prevailing in the device according to the invention is admitted to the upper collar. Consequently the outside pressure on the lower collar effects a tight seal between the trunk piston 60 and the packings 64 or 66, respectively, arranged in the collar areas. The suction operation will only be stopped when the float 50, by a rod system (not shown), lifts the trunk piston 60 in such a manner as to cause a connection between the atmosphere through the opening 62 to the inside of the ventilation valve.

Figure 5:
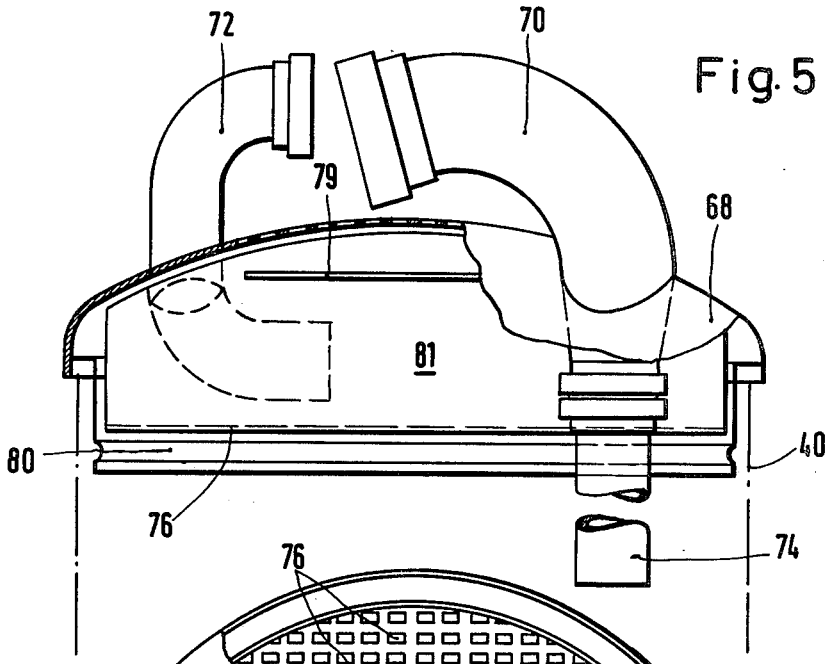
FIG. 5 is a sectional view of the cover area of a barrel being used as a hydraulic seal for the apparatus wherein the employed fire engine does not have an integral tank.
Figure 6:
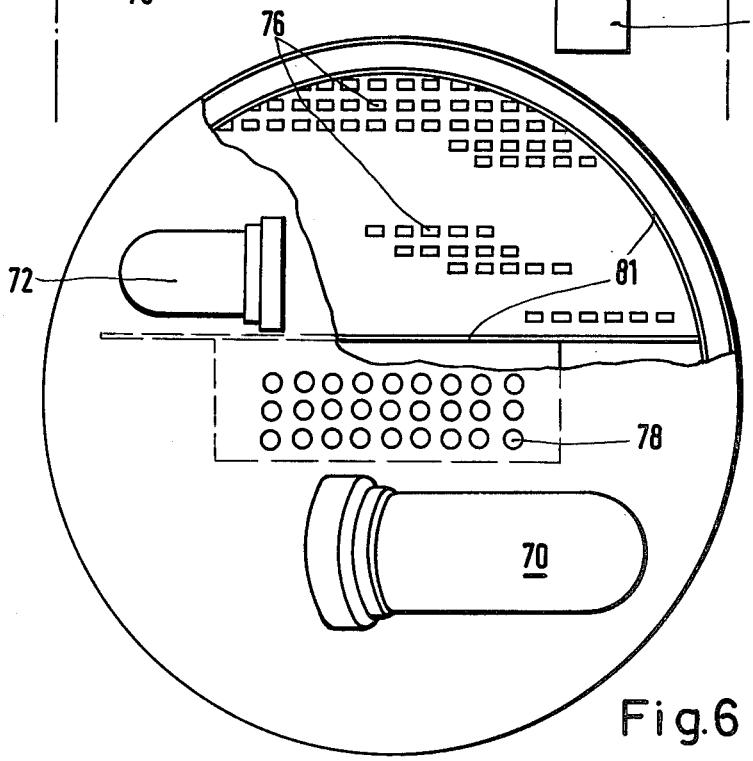
FIG. 6 is a top view of the barrel according to FIG. 5 with a part broken away and FIG. 7 is a perspective of a skimmer for removing harmful substances on the surface of liquids.

FIGS. 5 and 6 show parts of the vessel 40 of FIG. 2 serving as hydraulic seal for the closed water circulation. Preferably this vessel 40 is likewise a standard barrel being closed by a convex cover 68. The pipe unions 70 or 72, respectively, are passed through the cover 68, one taking out the power water and the other the pressurized water coming from the water jet pump 18. Hereby the compressed water is led into the cover almost horizontally. The power water is taken out from the vessel 40 through a sleeve 74 extending into the ground area. As shown in the top view of FIG. 6, holes 78 are provided wthin the area of the cover for ventilation of the vessel. The pressurized water connection itself terminates within a water tank 81 which is arranged below the cover 68 above the openings 78 and provided with gates 76 at the bottom. Through the latter the pressurized water mixed with the delivery air reaches the lower area of the vessel 40. In the cover area below the openings 78 and outside of the water tank 81, there is further provided a splash-board 79 to prevent water passing through the venting openings 78 from reaching the outside. In order to prevent the water from leaving the vessel, packing rings are provided between the edge of the vessel and the cover, as well as a collar 80 extending from the cover to the inside.

Figure 7:
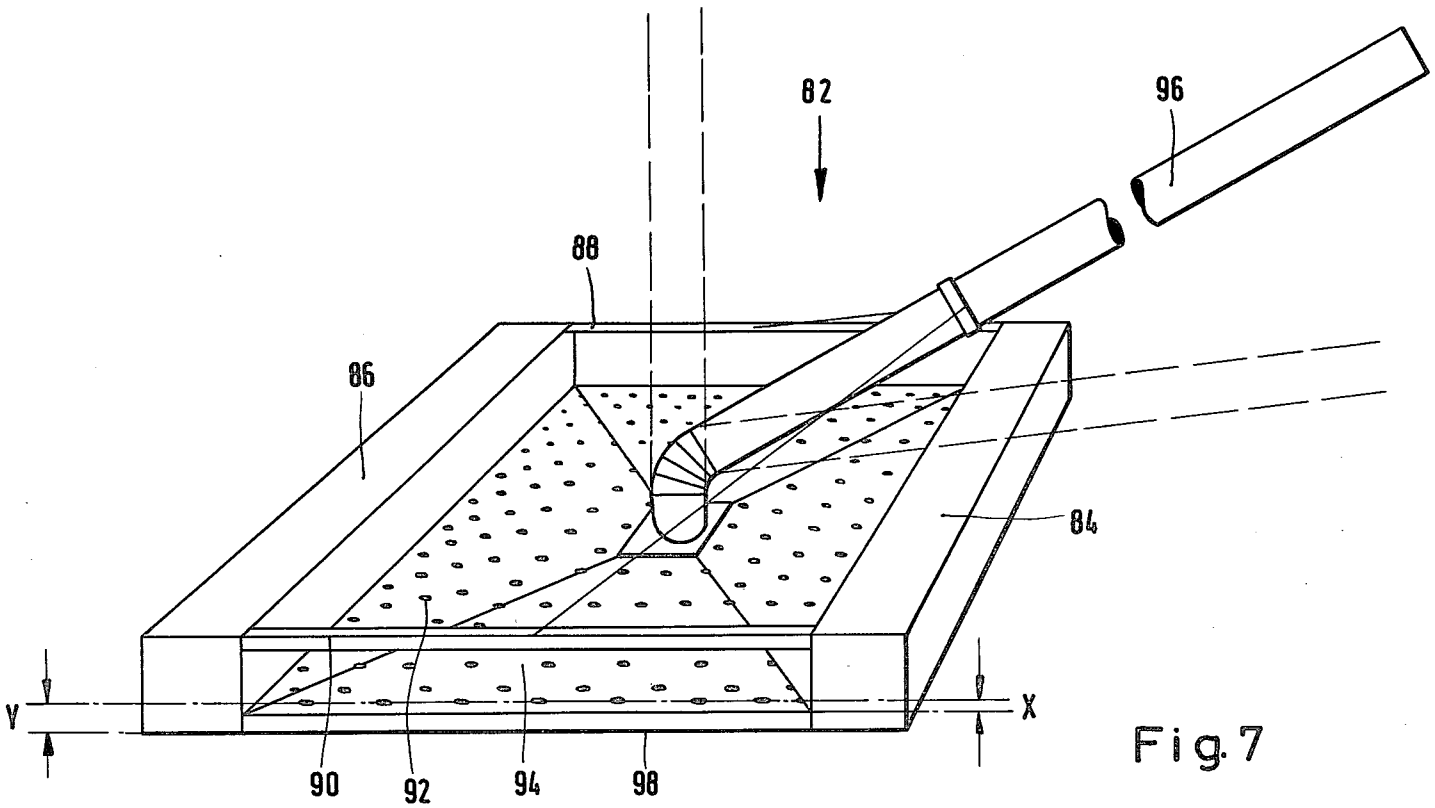

Finally FIG. 7 shows a skimmer that can be used instead of nozzle in the FIGS. 1 and 2 to suck up matter containing the harmful substances preferably in liquid form. The skimmer 82 presents a preferably rectangular shape. Further two lifting bodies 84 and 86 are provided being arranged parallel to each other. The float lifting bodies 84 and 86 are connected by bridges 88 and 90 in such a manner that liquid matter can flow between the lifting bodies 84 and 86. Further, in the lower marginal area of the lifting bodies 84 and 86 there is positioned a plate 94 having holes 92. The operation of the skimmer 82 is devised in such a manner that the skimmer can plunge into the liquid to be freed from harmful substances, so that the plate 94 provided with holes 92 will be placed somewhat below the surface of the liquid.

In FIG. 7 this distance is marked by "x". Tests have shown that this distance should be approximately 1 cm. The entire skimmer 82 will then be preferably e.g. $y=2$ cm within the liquid and at the bottom side it is sealed by means of a closed plate 98. Now in order to free the surface of the harmful substances, a suction tube 96 is preferably centrally connected with the plate 94 in such a manner that the harmful substances coming from the surface pass through the holes 92 to reach the suction tube 96 in order to be received in a collecting vessel 32. Thereby the plates 94 and 98 provide a jet effect. Preferably the suction tube 96 is adjustably arranged to be in a position to clean almost all areas of a liquid surface at random. Different positions of the suction tube 96 are shown in broken lines.

With the aid of the apparatus according to the invention it is possible for the first time, by simple means without any additional sources of power—except for the avalable units of a fire engine—to effect the removal of harmful substances contained in matter and especially to suck up liquids presenting differences in height of almost up to 10 meters as compared to arrangement where the suction unit is a water jet pump. The apparatus according to the invention is quickly ready for operation and can be put into action even at inaccessible places due to its ease in overcoming differences in level, provided that here are access roads for fire engines in the areas to be cleaned from the harmful substances.

Without limiting the scope of the invention, it is also possible to use the device according to the invention e.g. in fire tugs, if e.g. a water surface need be cleaned on which oil is floatinhg. In such a case the hydraulic seal would be an ocean, a lake or a river on which the fire tug is located.

Since only a small hydraulic seal is required to operate the device according to the invention, there is likewise a possibility of equipping suitably fitted aircraft, such as helicopters, etc., with the necessary devices in order to remove harmful substances at places inaccessible to land craft.

I claim:

1. A system for removing harmful solid and/or liquid matter from a surface, comprising, a separator means including an inlet for sucking said matter from said surface, a container for containing said matter after said sucking, and an outlet; a reservoir containing water; pump means including ejector means having a first inlet for feeding water from said reservoir, a second inlet for sucking fluid from the outlet of said separator means and an outlet means for discharging water into said reservoir, the pumping means pumping water from and back into the reservoir in a closed loop circulation to create a vacuum at said first-mentioned inlet.

2. Apparatus as defined in claim 1 wherein the pump means comprises a centrifugal pump in said closed loop to deliver water from said reservoir to said ejector means and then back into said reservoir.

3. Apparatus as defined in claim 2 wherein said ejector means, centrifugal pump and reservoir are mounted on a fire engine and wherein said reservoir is vented.

4. Apparatus as defined in claim 2 wherein said centrifugal pump has a working pressure of between 8 and 12 bars and said ejector means at the suction end thereof generates a pressure of about 0.1 bar.

5. Apparatus as defined in claim 1 wherein the top of said container is provided with an inlet fitting tangential to the wall of said container, said suction line being connected to said fitting.

6. Apparatus as defined in claim 5 and further including valve means in said top to discharge air into the atmosphere.

7. Apparatus as defined in claim 6 and further including float means in said container, said float means being connected to said valve means to open the valve means when the waste material reaches a predetermined level.

8. Apparatus as defined in claim 1 wherein the top of said container is a domed cap.

9. Apparatus as defined in claim 1, or 3, wherein said reservoir is provided with a domed cap, said closed loop pipe means communicating with said reservoir through said cap.

10. Apparatus as defined in claim 9 wherein a plate having a plurality of holes is provided horizontally within said reservoir adjacent to, but spaced below, the top thereof, the pressurized water from said ejector means being discharged within said reservoir above said plate through which it will flow to the lower portion thereof.

11. Apparatus as defined in claim 10 wherein the portion of the closed loop leading to the suction side of said ejector means passes from the bottom of said reservoir up through the plate and domed cap.

12. Apparatus as defined in claim 1 and further including a skimmer on the free end of said suction line, said skimmer being of rectangular shape having on two opposite sides a pair of float members, a first plate at the bottom of said skimmer and spanning said float members, an apertured plate spaced above said first plate, the free end of said suction line being connected to said apertured plate and in communication with the space between it and said first plate.

* * * * *